US005103899A

United States Patent [19]

Kalina

[11] Patent Number: 5,103,899

[45] Date of Patent: Apr. 14, 1992

[54] MULTI-FLOW TUBULAR HEAT EXCHANGER

[76] Inventor: Alexander I. Kalina, 105 Glen Garry Way, Hillsborough, Calif. 94010

[21] Appl. No.: 576,221

[22] Filed: Aug. 31, 1990

[51] Int. Cl.[5] ..... F28D 15/02

[52] U.S. Cl. ..... 165/104.13; 165/104.14; 165/104.21; 165/111

[58] Field of Search ..... 165/104.14, 104.13, 165/104.21, 111

[56] References Cited

FOREIGN PATENT DOCUMENTS

| | | | |
|---|---|---|---|
| 2403285 | 7/1975 | Fed. Rep. of Germany | 165/104.13 |
| 2753483 | 6/1979 | Fed. Rep. of Germany | 165/104.14 |
| 36065 | 4/1978 | Japan | 165/104.14 |
| 35823 | 3/1980 | Japan | 165/104.13 |
| 1044948 | 9/1983 | U.S.S.R. | 165/104.14 |

*Primary Examiner*—Albert W. Davis, Jr.
*Attorney, Agent, or Firm*—Arnold, White & Durkee

[57] ABSTRACT

A multi-flow tubular heat exchanger is enclosed. The heat exchanger includes a shell that encloses one or more cooling stream tubes, one or more heating stream tubes, and a heat transfer fluid.

4 Claims, 2 Drawing Sheets

MULTI-FLOW TUBULAR HEAT EXCHANGER

BACKGROUND OF THE INVENTION

The present invention relates to the field design of heat exchangers. The invention has particular application to shell and tube heat exchangers.

Single flow and multiple flow shell and tube heat exchangers are widely used. In the single flow heat exchanger, one fluid passes through the heat exchanger between the shell and the tubes enclosed within the heat exchanger and the other fluid passes through the tubes. One of these fluids is cooled, and the other is heated. In the multiple flow heat exchanger, several groups of tubes are enclosed within the heat exchanger shell. A different fluid passes through each group of tubes, but only one fluid passes through the region between the shell and the tubes.

In modern power, chemical and other plants requiring heat exchange between different streams of fluid, it may be necessary to cause heat to transfer from several heating streams to several cooling streams. Such heat exchange is typically carried out through the use of several heat exchangers. This complicates the plant layout, making it difficult to properly balance the heat transfer. Accordingly, there is a need for a heat exchanger that provides for heat transfer from several heating streams to several cooling streams. The heat exchanger of the present invention provides such an apparatus.

SUMMARY OF THE INVENTION

The present invention provides a heat exchanger comprising:

a shell;

at least one cooling stream tube enclosed within the shell;

at least one heating stream tube enclosed within the shell; and a heat transfer fluid enclosed within the shell.

The heat exchanger of the present invention preferably includes at least two cooling stream tubes and at least two heating stream tubes enclosed within the shell, and at least one baffle, enclosed within the shell, to divide the shell into at least two sections, with the composition of the heat transfer fluid differing for each section.

The present invention also provides for a method for transferring heat from a heating stream to a cooling stream comprising:

feeding the heating stream into a heating stream tube enclosed within a heat exchanger shell that includes a heat transfer fluid that encompasses the heating stream tube; and feeding the cooling stream into a cooling stream tube enclosed within the heat exchanger shell.

DETAILED DESCRIPTION OF SPECIFIC EMBODIMENTS

The heat exchanger of the present invention includes a shell that encloses at least one cooling stream tube, at least one heating stream tube, and a heat transfer fluid.

The shell may be of any shape or size. The term "shell" as used in this application refers to any container, or system of containers and connecting conduits, that serves to enclose the cooling stream and heating stream tubes and the heat transfer fluid, and that permits the heat transfer fluid to pass between the region of the shell containing the cooling stream tube or tubes and the region of the shell containing the heating stream tube or tubes. The shell may, for example, comprise a substantially cylindrical or rectangular shaped container that includes both the cooling stream and heating stream tubes within the same container. Alternatively, the shell may comprise a cooling stream tube container and a heating stream tube container that may be separated from one another. In such an alternative embodiment, the shell may further comprise at least one conduit connecting the cooling stream tube container to the heating stream tube container, allowing the heat transfer fluid to pass between those two containers via that conduit or conduits Thus, the shell of the heat exchanger of the present invention includes any container, or system of containers and connecting conduits, that may be used to enclose a system for transferring heat from a heating stream to a cooling stream that includes the following: a heating stream that passes through a heating stream tube that is in close association with a heat transfer fluid such that heat transferred from the heating stream heats the heat transfer fluid as the heating stream cools; means for boiling the heat transfer fluid to produce a heat transfer fluid vapor; means for transferring the heat transfer fluid vapor to a region that is in close association with a cooling stream flowing through a cooling stream tube such that heat transferred from the heat transfer fluid vapor heats the cooling stream as the heat transfer fluid vapor cools; means for condensing the heat transfer fluid vapor to produce the heat transfer fluid; and means for returning the heat transfer fluid to a region that is in close association with the heating stream that passes through the heating stream tube.

The cooling and heating stream tubes may comprise single tubes or tube groups having two or more tubes in each group. Preferably, the heat exchanger of the present invention includes at least two cooling stream tubes (or cooling stream tube groups) and at least two heating stream tubes (or heating stream tube groups) enclosed within the shell.

Figure 1:
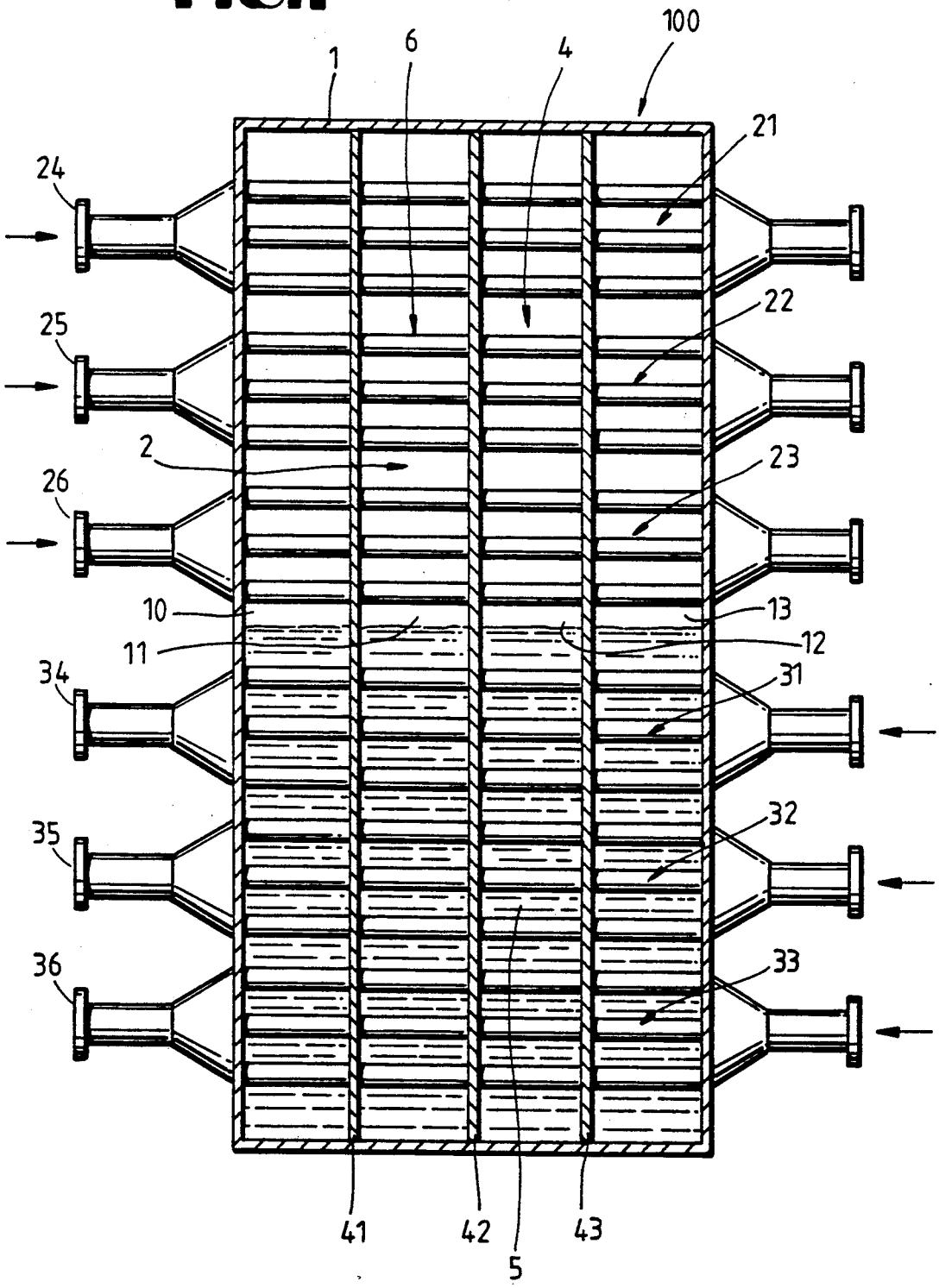
FIG. 1 is a schematic cross-section of an embodiment of the heat exchanger of the present invention.

The shell may include one or more baffles that divide the shell into different sections. The composition of the heat transfer fluid, in such an embodiment of the present invention, preferably differs for each different section FIG. 1 shows a preferred embodiment of the heat exchanger 100 of the present invention in which shell 1 encloses tube groups 21, 22, 23, 31, 32 and 33. Tube groups 21–23 are for passing three cooling streams 24, 25, 26. Tube groups 31–33 are for passing three heating streams 34, 35, 36. Shell 1 encloses three baffles 41, 42 and 43 oriented in a plane perpendicular to that of tube groups 21–23 and 31–33. Baffles 41–43 divide the space 2 enclosed within shell 1 into four sections 10, 11, 12 and 13.

Each section 10–13 is partially filled with heat transfer fluid 5. Heat transfer fluid 5 may in extremely low temperature systems comprise fluids existing in a liquid state only at cryogenic temperatures, such as liquid nitrogen, oxygen, helium or argon. Heat transfer fluid 5 may comprise mixtures of freons or low boiling hydrocarbons for systems operating at low temperatures; water, ammonia mixtures and mixtures of higher boiling hydrocarbons for systems operating at moderate temperature; or mixtures of silicones for systems operating at very high temperatures.

Preferably, heat transfer fluid 5 comprises a low boiling component and a high boiling component, such as would be included in an ammonia, water mixture or mixtures of two or more cryogenic fluids, freons, hydrocarbons, and the like. In a preferred embodiment of the present invention, heat transfer fluid 5 consists of the same components, but has a composition that differs for each section 10, 11, 12 and 13. For example, sections 10–13 may each enclose a heat transfer fluid 5 that includes a water, ammonia mixture. However, the percentage of ammonia may be higher in section 10 than it is in sections 11–13.

When in use, the average temperature for heat transfer fluid 5 preferably differs for each section 10–13. Preferably, the composition of heat transfer fluid 5 in each section 10–13 should be chosen so that the lower the average temperature of the section, the higher the percentage of the low boiling component of heat transfer fluid 5.

In the embodiment shown in FIG. 1, the composition of heat transfer fluid 5 preferably has a higher percentage of the lower boiling component in those sections 10–13 of heat exchanger 100 through which passes fluid having a lower temperature. In the FIG. 1 embodiment, in which cooling streams passing through tube groups 21–23 pass from left to right and heating streams passing through tube groups 31–33 pass from right to left, fluid within section 10 is at a lower temperature than fluid within sections 11–13. In that embodiment, the composition of heat transfer fluid 5 preferably should have a higher percentage of the lower boiling component in section 10 than it has in sections 11–13. Likewise, the composition of heat transfer fluid 5 preferably should have a higher percentage of the lower boiling component in section 11 than it has in sections 12 and !3, and in section 12 than it has in section 13.

The compositions of heat transfer fluid 5 within sections 10–13 should be chosen so that the temperature at which it starts to boil is less than the temperature of at least one of the heating streams 34–36 as that heating stream or streams flow through that section. The compositions of heat transfer fluid 5 within sections 10–13 also should be chosen so that the temperature at which it starts to condense is greater than the temperature of at least one of the cooling streams 24–26 as that cooling stream or streams flow through that section. (If the temperature of the heating streams 34–36 is too low to boil heat transfer fluid 5, an external heat source may be used to supplement heat transferred from heating streams 34–36 to boil heat transfer fluid 5. If the temperature of the cooling streams 24–26 is too high to condense heat transfer fluid vapor 6, an external cooling source may be used to supplement cooling streams 24–26 to condense heat transfer fluid vapor 6.)

In the embodiment shown in FIG. 1, heat transfer fluid 5 within region 3 that includes heating stream tube groups 31–33 is predominately in a liquid state and heat transfer fluid vapor 6 within region 4 that includes cooling stream tube groups 21–23 is predominately in a vapor state.

In operation, the embodiment of t e heat exchanger of the present invention, shown in FIG. 1, should perform its function in the following manner: Cooling streams 24–26 pass through cooling tube groups 21–23 in a direction countercurrent to the flow of heating streams 34–36 passing through heating tube groups 31–33. Cooling streams 24–26 and heating streams 34–36 may be in the state of a saturated vapor, superheated vapor, saturated liquid, subcooled liquid, or vapor-liquid mixture. Cooling streams 24–26 and heating streams 34–36 may include a single component or a mixture of a low boiling component and a high boiling component. Heating streams 34–36 passing through tube groups 31–33 heat the heat transfer fluid 5, causing it to boil. Evaporated vapors of heat transfer fluid 5 rise within shell 1 until contacting tube groups 21–23, through which cooling streams 24–26 pass. Heat transfer fluid vapor 6 condenses on the surface of tube groups 21–23, producing condensation that drops back into heat transfer fluid 5. This process proceeds in a continuous manner.

Preferably, the same pressure should be maintained in each section 10–13 of shell 1 to prevent leakage of heat transfer fluid 5 from one section 10–13 to another section 10–13. In the ideal system, the composition of heat transfer fluid 5 in each section 10–13 will remain constant.

Even if some degree of leakage of heat transfer fluid 5 from one section 10–13 to another section 10–13 takes place, the appropriate compositions for heat transfer fluid 5 for each section 10–13 can be easily restored. This can be done by simply transferring an appropriate amount of vapor from a section 10–13 having too high a composition of the lower boiling component to a section having too low a composition of the lower boiling component. Alternatively, some quantity of liquid may be bypassed from a section having too high a percentage of the higher boiling component to a section having too low a percentage of the higher boiling component.

For example, if the percentages of the higher and lower boiling components of lower temperature section 10 and higher temperature section 11 begin to equalize, appropriate compositions can be restored by transferring an appropriate amount of vapor from section 11 to section 10 or an appropriate amount of liquid from section 10 to section 11. Standard automatic control means may be used to maintain the differences in heat transfer fluid 5 composition in different sections 10–13.

Shell 1 may include one or more sealable ports through which heat transfer fluid may be added or removed. Because shell 1 must be completely enclosed during use, any such ports must be adequately sealed during use of the heat exchanger to prevent heat transfer fluid vapors from escaping from the heat exchanger.

Figure 2:
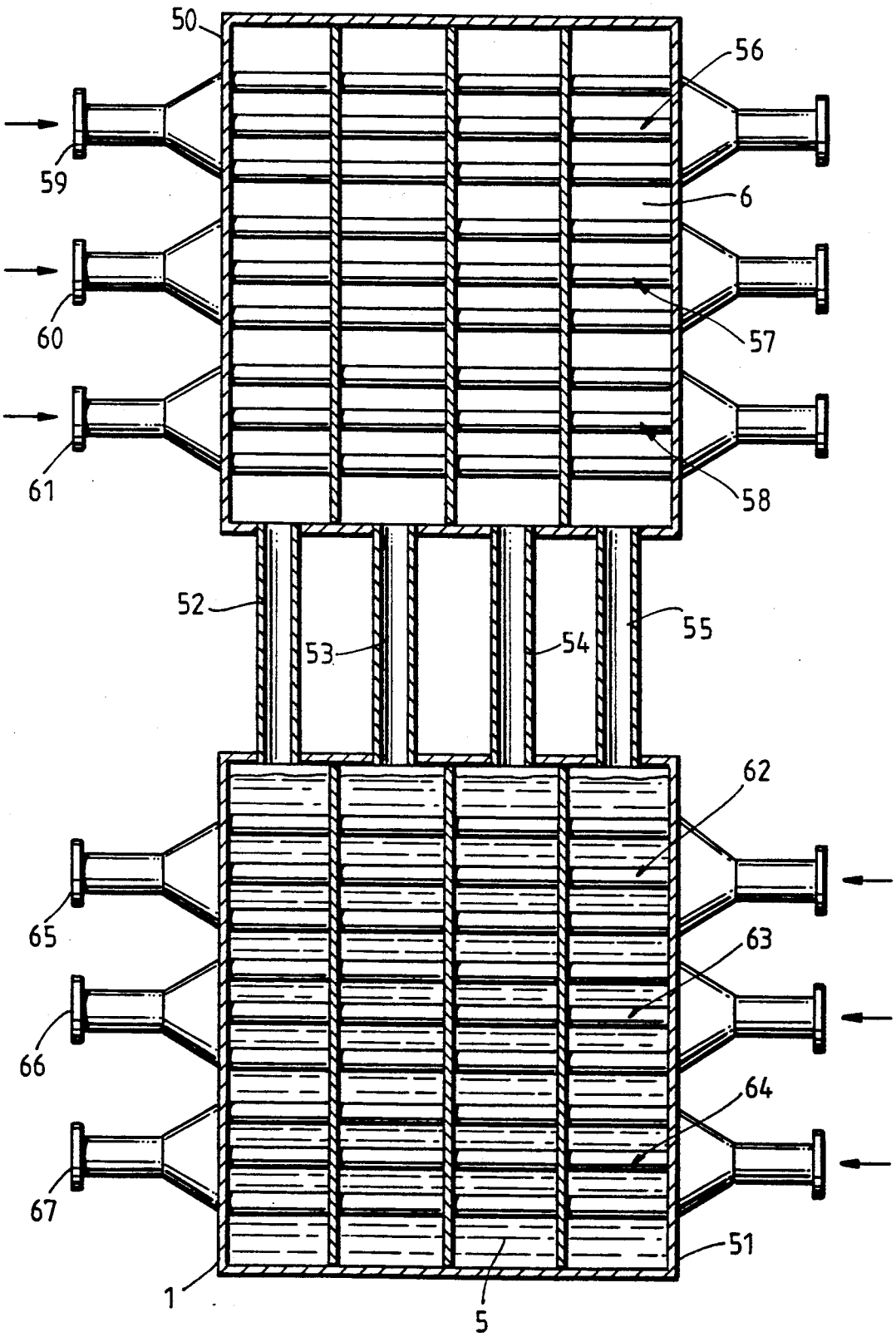
FIG. 2 is a schematic cross-section of a second embodiment of the heat exchanger of the present invention

Shell 1 may be configured as shown in the embodiment of the present invention shown in FIG. 2. In that embodiment, shell 1 comprises first and second containers 50, 51 and conduits 52, 53, 54 and 55 for connecting first container 50 to second container 51. First container 50 encompasses cooling stream tube groups 56, 57 and 58, through which pass cooling streams 59, 60 and 61. Second container 51 encompasses heating stream tube groups 62, 63 and 64, through which pass heating streams 65, 66 and 67. Second container 51 includes heat transfer fluid 5 that is predominately in a liquid state. First container 50 includes heat transfer fluid vapor 6 that is predominately in a vapor state. Heat transferred from heating streams 65–67 to heat transfer fluid 5 causes heat transfer fluid 5 to boil producing heat transfer fluid vapor 6. Heat transfer fluid vapor 6 passes through conduits 52–55 to first container 50. Heat transferred from heat transfer fluid vapor 6 to cooling streams 59–61 heats those streams while heat transfer fluid vapor 6 condenses. That condensate returns to second container 51 through conduits 52–55.

While the present invention has been described with respect to a particular preferred embodiment, those skilled in the art will appreciate a number of variations and modifications of that embodiment. For example, the heat exchanger of the present invention can include any number of cooling stream tubes or heating stream tubes through which may pass any number of cooling and heating streams of any variation in composition or temperature. Similarly, the heat transfer fluid may be divided into any number of different sections within the shell of the heat exchanger, including different compositions of the heat transfer fluid in each section. Thus, it is intended that the appended claims cover all such variations and modifications as fall within the true spirit and scope of the present invention.

What is claimed is:

1. A heat exchanger comprising:

a shell;

at least one cooling stream tube enclosed within the shell, said cooling stream tube including a cooling stream comprising a low boiling component and a high boiling component;

at least one heating stream tube enclosed within the shell; and a heat transfer fluid, comprising a low boiling component and a high boiling component, enclosed within the shell.

2. The heat exchanger of claim 1 wherein the heating stream tube includes a heating stream comprising a low boiling component and a high boiling component.

3. A method for transferring heat from a heating stream to a cooling stream that includes a low boiling component and a high boiling component comprising:

feeding the heating stream into a heating stream tube enclosed within a heat exchanger shell that includes a heat transfer fluid, comprising a low boiling component and a high boiling component, that encompasses the heating stream tube; and feeding the cooling stream into a cooling stream tube enclosed within the heat exchanger shell.

4. The method of claim 2 wherein the heating stream comprises a low boiling component and a high boiling component.

* * * * *